US010145278B2

(12) United States Patent
Nawa

(10) Patent No.: US 10,145,278 B2
(45) Date of Patent: Dec. 4, 2018

(54) BLOW-BY GAS PASSAGE STRUCTURE

(71) Applicant: TOYOTA BOSHOKU KABUSHIKI KAISHA, Aichi-ken (JP)

(72) Inventor: Teruyoshi Nawa, Aichi-ken (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 144 days.

(21) Appl. No.: 15/086,981

(22) Filed: Mar. 31, 2016

(65) Prior Publication Data

US 2016/0333753 A1 Nov. 17, 2016

(30) Foreign Application Priority Data

May 14, 2015 (JP) ..... 2015-099441
Mar. 10, 2016 (JP) ..... 2016-047600

(51) Int. Cl.
*F01M 13/04* (2006.01)
*F02F 1/24* (2006.01)
*F02F 7/00* (2006.01)

(52) U.S. Cl.
CPC ..... *F01M 13/0416* (2013.01); *F02F 7/006* (2013.01); *F01M 2013/0461* (2013.01)

(58) Field of Classification Search
CPC ..... F01M 13/04; F01M 13/0416; F01M 2013/0038; F01M 2013/0433; F01M 2013/0461; F02F 1/24; F02F 7/0065; F02M 35/10222
See application file for complete search history.

(56) References Cited

U.S. PATENT DOCUMENTS 7,243,642 B2 * 7/2007 Nishikawa ..... F01M 13/0416 123/572
7,631,639 B2 * 12/2009 Yonebayashi ..... F01M 13/0416 123/572

(Continued)

FOREIGN PATENT DOCUMENTS

CN 101122249 2/2008
CN 102297002 12/2011

(Continued)

OTHER PUBLICATIONS

Machine Translation of JP10-26012, Ishiyama et al., Jan. 1998, obtained from http://worldwide.espacenet.com/, pp. 1-9.*

(Continued)

*Primary Examiner* — Grant Moubry
(74) *Attorney, Agent, or Firm* — Greenblum & Bernstein, P.L.C.

(57) ABSTRACT

A blow-by gas passage structure is provided inside a separator chamber that is formed between a cylinder head cover and a baffle plate joined to the cylinder head cover by vibration welding. A first rib is provided on the opposite surface of one member of the cylinder head cover and the baffle plate, while a second rib is provided on the opposite surface of the other member, at positions upstream of the first rib in the flow of the blow-by gas and adjacent a gap formed between the distal end of the first rib and the opposite surface of the other member. The second rib has a height that is equal to or larger than the height of the gap so as to prevent passing of the blow-by gas through the gap.

9 Claims, 5 Drawing Sheets

(56) References Cited

U.S. PATENT DOCUMENTS

| | | | | |
|---|---|---|---|---|
| 7,946,279 | B2 * | 5/2011 | Suzuki | B62M 7/02 123/572 |
| 8,252,079 | B2 * | 8/2012 | Gruhler | B29C 65/58 55/320 |
| 8,381,706 | B2 * | 2/2013 | Akiyama | F01M 13/0416 123/195 C |
| 8,474,442 | B2 * | 7/2013 | Festag | F01M 13/0416 123/572 |
| 8,480,777 | B2 | 7/2013 | Sakaguchi et al. | |
| 9,463,403 | B2 * | 10/2016 | Wakabayashi | B01D 45/08 |
| 9,656,198 | B2 | 5/2017 | Sugio et al. | |
| 2015/0040767 | A1 | 2/2015 | Sugio et al. | |

FOREIGN PATENT DOCUMENTS

| | | | | |
|---|---|---|---|---|
| CN | 104271949 | | 1/2015 | |
| CN | 104350247 | | 2/2015 | |
| CN | 104603409 | | 5/2015 | |
| EP | 1870571 | A2 * | 12/2007 | F01M 13/0416 |
| JP | 09112358 | A * | 4/1997 | F02F 7/006 |
| JP | 10026012 | A * | 1/1998 | |
| JP | H10-026012 | | 1/1998 | |
| JP | 2005048601 | A * | 2/2005 | |
| JP | 2005337123 | A * | 12/2005 | |
| JP | 2007332874 | A * | 12/2007 | |
| JP | 4353473 | | 8/2009 | |
| JP | 2011-58433 | | 3/2011 | |
| JP | 2013096229 | A * | 5/2013 | |
| JP | WO 2013061741 | A1 * | 5/2013 | F01M 13/04 |
| JP | 2013113109 | A * | 6/2013 | |
| JP | 2014-173542 | | 9/2014 | |

OTHER PUBLICATIONS

Chinese Office Action in counterpart Chinese application No. 201610293897.0, dated Feb. 27, 2018 (with English-language translation).

* cited by examiner

FIG.5 [Related Art]
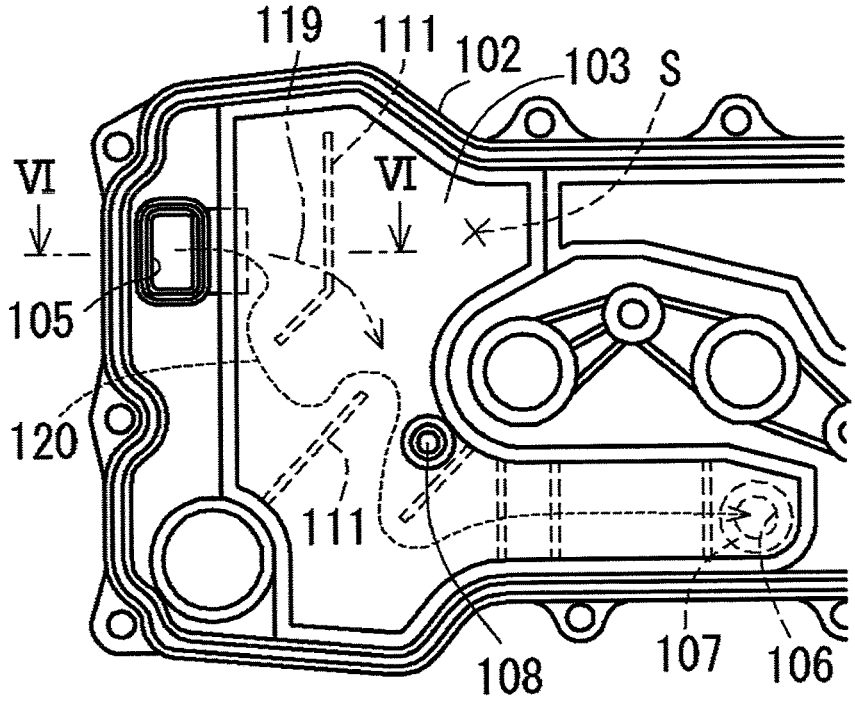
FIG.6 [Related Art]
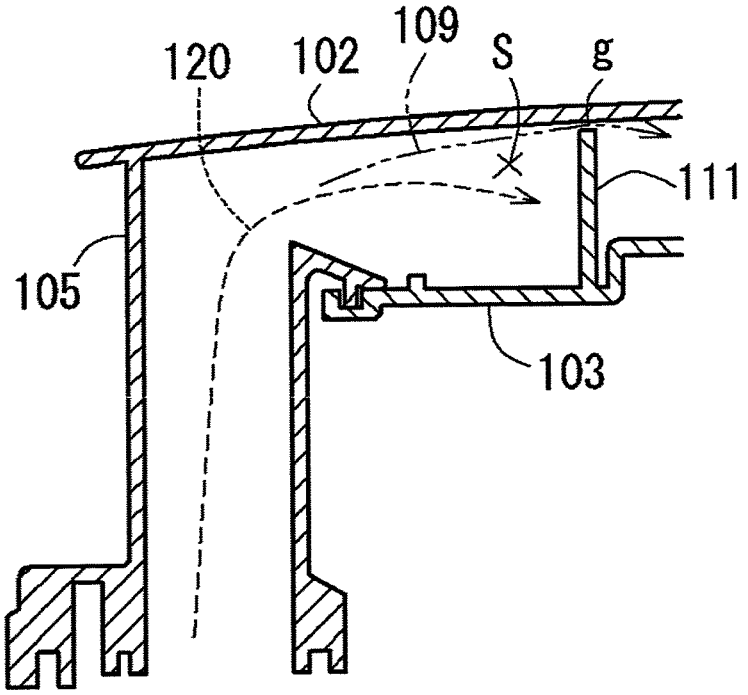

BLOW-BY GAS PASSAGE STRUCTURE

CROSS-REFERENCE TO RELATED APPLICATIONS

The present application claims priority under 35 U.S.C. § 119 of Japanese Application No. 2015-99441 filed on May 14, 2015 and Japanese Application No. 2016-47600 filed on Mar. 10, 2016, the disclosure of which is expressly incorporated by reference herein in its entirety.

BACKGROUND

1. Technical Field

The present invention relates to a blow-by gas passage structure, and more particularly to a blow-by gas passage structure provided inside a separator chamber that is formed between a cylinder head cover and a baffle plate joined to the cylinder head cover by vibration welding.

2. Background Art

As a conventional oil mist separator, one provided inside a separator chamber that is formed between a cylinder head cover and a baffle plate joined to the cylinder head cover by vibration welding is commonly known (see, for example, JP2011-58433A). In this conventional oil mist separator, for example, as shown in FIG. 5 and FIG. 6, path-bending ribs 111 stand on the surface(s) of the cylinder head cover 102 and/or baffle plate 103 to cause the flow of blow-by gas to bend (meander) in a planar direction inside the separator chamber S. The flow of blow-by gas introduced from an inlet 105 into the separator chamber S is bent by path-bending ribs 111, and the oil components in the blow-by gas are caught through gravity sedimentation and collision. After that, the blow-by gas, from which the oil components have been separated, is discharged from the separator chamber S by a PCV valve 107 provided to an outlet 106, and transferred to the combustion chamber of the engine via an intake manifold or the like.

In the conventional oil mist separator described above, there is a gap g between the distal end of the path-bending ribs 111 and the surface of the opposing member (cylinder head cover 102 or baffle plate 103) in order to avoid interference (i.e., vibration welding) therebetween. This is because interference between the path-bending ribs 111 and the surface of the opposing member will cause the following problems. For example, burrs (foreign matter) may form after the vibration welding, or flash trap design for the vibration welding may become difficult. If the path-bending ribs 111 are high and have low rigidity, the path-bending ribs 111 may wobble largely by the vibration during the vibration welding, which may impede the heating of the resin and result in a weld failure.

Since a gap g is formed between the distal end of the path-bending ribs 111 and the surface of the opposing member for avoiding interference in the conventional oil mist separator described above, part of the blow-by gas passes through the gap g, thus creating a short-cut flow path 119. Therefore, the flow path 120 of the blow-by gas may not form as designed and intended, and the flow of blow-by gas may not be bent sufficiently, with a result that the efficiency of separating oil components in the blow-by gas is lowered.

Moreover, in the conventional oil mist separator described above, when the negative pressure inside the separator chamber S is high and when the PCV valve 107 (outlet 106) and the oil drop hole 108 are disposed close to each other, the blow-by gas is sucked into the separator chamber S through the oil drop hole 108 and flows toward the PCV valve 107. Therefore, for example, a blocking rib that blocks the flow of blow-by gas from the oil drop hole 108 toward the outlet 106 could be provided on the surface of the cylinder head cover 102 or the baffle plate 103. Even such a blocking rib would have to be formed with a gap g for avoiding interference between its distal end and the surface of the opposing member, similarly to the path-bending ribs 111 described above. Part of the blow-by gas would then pass through the gap g and thereby a short-cut flow path would be created. As a result, the effect of blocking the blow-by gas would be lowered, and the efficiency of separating oil components in the blow-by gas would also be lowered.

SUMMARY

The embodiments of the present invention were made in view of the circumstances described above, with an object to provide a blow-by gas passage structure that can improve the efficiency of separating oil components contained in the blow-by gas.

One aspect of the present embodiments provides a blow-by gas passage structure provided inside a separator chamber that is formed between a cylinder head cover and a baffle plate joined to the cylinder head cover by vibration welding to form a passage for blow-by gas introduced into the separator chamber for separation of oil components, wherein the cylinder head cover and the baffle plate include respective opposite surfaces that face each other in an up and down direction of the cylinder head cover, the opposite surface of either one of the cylinder head cover and the baffle plate is provided with a first rib, and the opposite surface of the other member is provided with a second rib at a position which is in the upstream of the first rib in a flow of the blow-by gas and which is adjacent to a gap formed between a distal end of the first rib and the opposite surface of the other member, and the second rib has a height that is equal to or greater than a height of the gap so as to prevent passing of the blow-by gas through the gap.

In a further aspect, the first rib and the second rib may be path-bending ribs provided for causing the flow of the blow-by gas to bend along a planar direction of the cylinder head cover inside the separator chamber.

In a further aspect, the first and second path-bending ribs may be disposed opposite an inlet for introducing the blow-by gas into the separator chamber.

In a further aspect, the first rib and the second rib may be blocking ribs provided for blocking a flow of blow-by gas traveling from an oil drop hole for discharging separated oil components from the separator chamber toward an outlet through which the blow-by gas is discharged from the separator chamber.

In a further aspect, the second rib may include an inclined surface that separates from the gap in the up and down direction as it approaches the first rib.

In a further aspect, the first rib and the second rib may be disposed such as not to interfere with each other when the cylinder head cover and the baffle plate are joined together by vibration welding.

In a further aspect, the first rib and the second rib adjacent to each other may be distanced from each other by 1 to 10 mm.

In the blow-by gas passage structure of this embodiment, the cylinder head cover and the baffle plate include respective opposite surfaces that face each other in an up and down direction of the cylinder head cover. The opposite surface of one member of the cylinder head cover and the baffle plate is provided with a first rib, while the opposite surface of the other member is provided with a second rib at a position upstream of the first rib in a flow of the blow-by gas and adjacent a gap formed between a distal end of the first rib and the opposite surface of the other member. The second rib has a height that is equal to or larger than the height of the gap so as to prevent passing of the blow-by gas through the gap. Thereby, passing of the blow-by gas through the gap is prevented by the first rib and the second rib. As a result, the efficiency of separating oil components contained in the blow-by gas can be improved.

When the first rib and the second rib are provided for bending the gas path, the flow of blow-by gas is bent in the planar direction of the cylinder head cover inside the separator chamber by these first and second path-bending ribs, so that the oil components in the blow-by gas are separated from the gas. Since passing of the blow-by gas through the gaps is prevented by the first and second path-bending ribs, a flow path of blow-by gas is formed as designed and intended, and the flow of blow-by gas can be bent sufficiently.

When the first and second path-bending ribs are disposed opposite the inlet, the oil components in the blow-by gas will be effectively separated, since the blow-by gas collides the first and second path-bending ribs with a high flow rate when it is introduced from the inlet into the separator chamber. Furthermore, passing of the blow-by gas with a high flow rate through the gaps is prevented by the first and second path-bending ribs.

When the first rib and the second rib are provided for blocking the gas, the flow of blow-by gas that travels from the oil drop hole toward the outlet inside the separator chamber will be blocked by the first and second blocking ribs. Also, since the first and second blocking ribs prevent passing of the blow-by gas through the gaps, the effect of blocking the blow-by gas is enhanced.

When the second rib includes an inclined surface, the blow-by gas will be guided by the inclined surface of the second rib to move away from the gap in the up and down direction. Therefore, passing of the blow-by gas through the gaps can be prevented more reliably.

Furthermore, when the first rib and the second rib are disposed such as not to interfere with each other when the cylinder head cover and the baffle plate are joined together by vibration welding, no burrs will form in the vibration welding on the first and second ribs.

Moreover, when the first rib and the second rib adjacent thereto are distanced from each other by 1 to 10 mm, passing of the blow-by gas through the gaps can be prevented effectively.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 5 is a backside view of essential parts of a cylinder head cover provided with a conventional oil mist separator; and FIG. 6 is a cross-sectional view along line VI-VI of FIG. 5.

DETAILED DESCRIPTION

Figure 1:
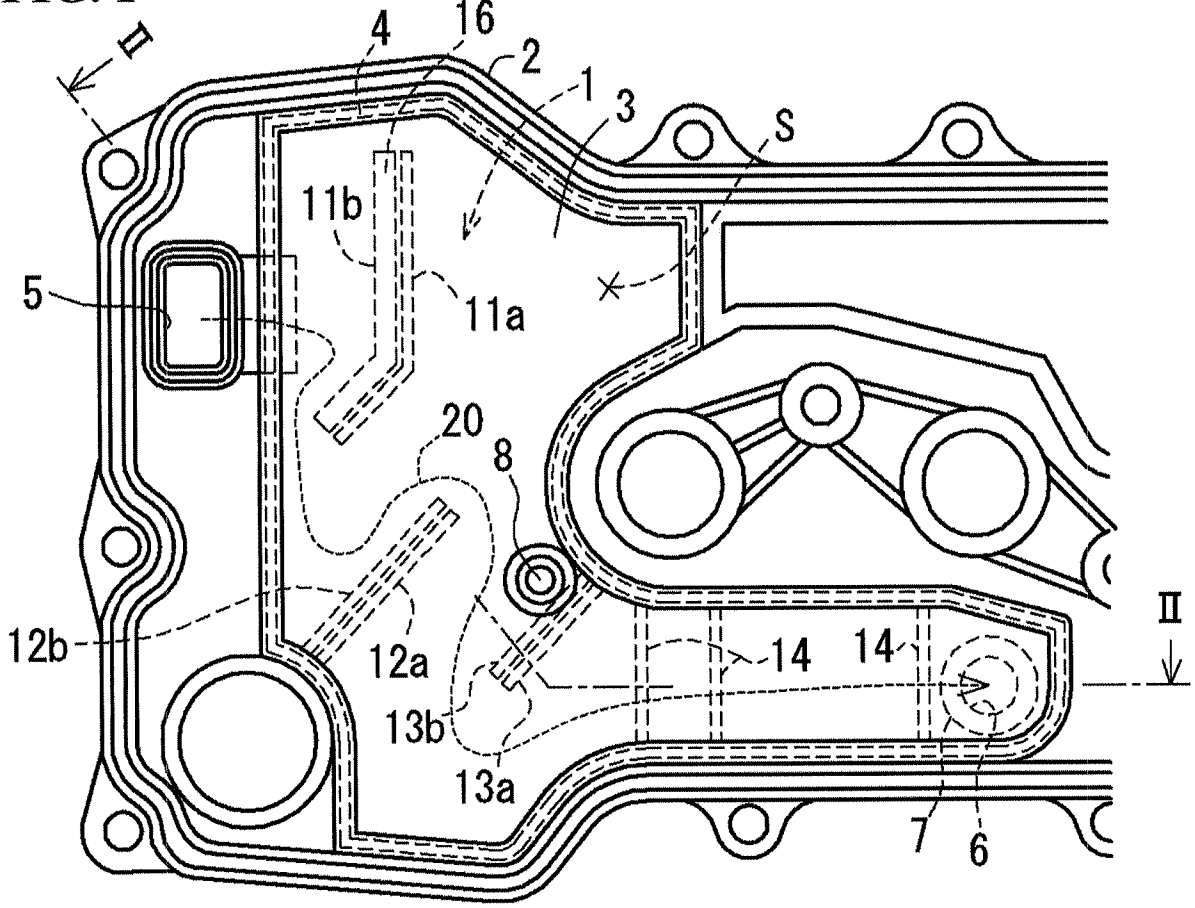
FIG. 1 is a backside view of essential parts of a cylinder head cover provided with a blow-by gas passage structure according to Embodiment 1.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

<Blow-by Gas Passage Structure>

The blow-by gas passage structure according to this embodiment is a blow-by gas passage structure (1, 1') provided inside a separator chamber (S) that is formed between a cylinder head cover (2) and a baffle plate (3) joined to the cylinder head cover by vibration welding, for constituting a passage for blow-by gas introduced into the separator chamber for separation of oil components (see, for example, FIGS. 1 to 4). The cylinder head cover (2) and the baffle plate (3) include respective opposite surfaces (2*a*, 3*a*) that face each other in an up and down direction (P) of the cylinder head cover. First ribs (11*a*, 12*a*, 13*a*, 23*a*) are provided on the opposite surface of one member of the cylinder head cover and the baffle plate, while second ribs (11*b*, 12*b*, 13*b*, 23*b*) are provided on the opposite surface of the other member, at positions upstream of the first ribs in the flow of the blow-by gas and adjacent a gap (g) formed between the distal ends of the first ribs and the opposite surface of the other member. The second ribs (11*b*, 12*b*, 13*b*, 23*b*) have a height that is equal to or larger than the height of the gap (g) so as to prevent passing of the blow-by gas through the gap (g).

As used herein, the term "prevent" is intended to mean prevention of passing of a total amount or a considerable percentage of blow-by gas through the gap. For example, the first ribs and second ribs can prevent 80% or more of a total flow amount of the blow-by gas introduced into the separator chamber from passing through the gap. The distance between a first rib and a second rib (d1; see FIG. 2 and FIG. 4) can be set as appropriate, as long as the ribs do not interfere with each other when the cylinder head cover and the baffle plate are joined by vibration welding, and as long as passing of blow-by gas through the gap can be prevented. The distance between adjacent ribs (d1) can be, for example, 1 to 10 mm (preferably 1 to 5 mm, and more preferably 2 to 3 mm). In the case with the embodiment described above, the cylinder head cover (2) may be formed in a box-like shape with the bottom side open, for example, and the baffle plate (3) may be joined to the cylinder head cover such as to close the bottom side.

The blow-by gas passage structure according to this embodiment may be formed to include, for example, first ribs (11*a*, 12*a*, 13*a*) and second ribs (11*b*, 12*b*, 13*b*) for bending the gas path (see, for example, FIGS. 1 to 4) to cause the flow of blow-by gas to bend along a planar direction of the cylinder head cover (2) inside the separator chamber (S).

Figure 2:
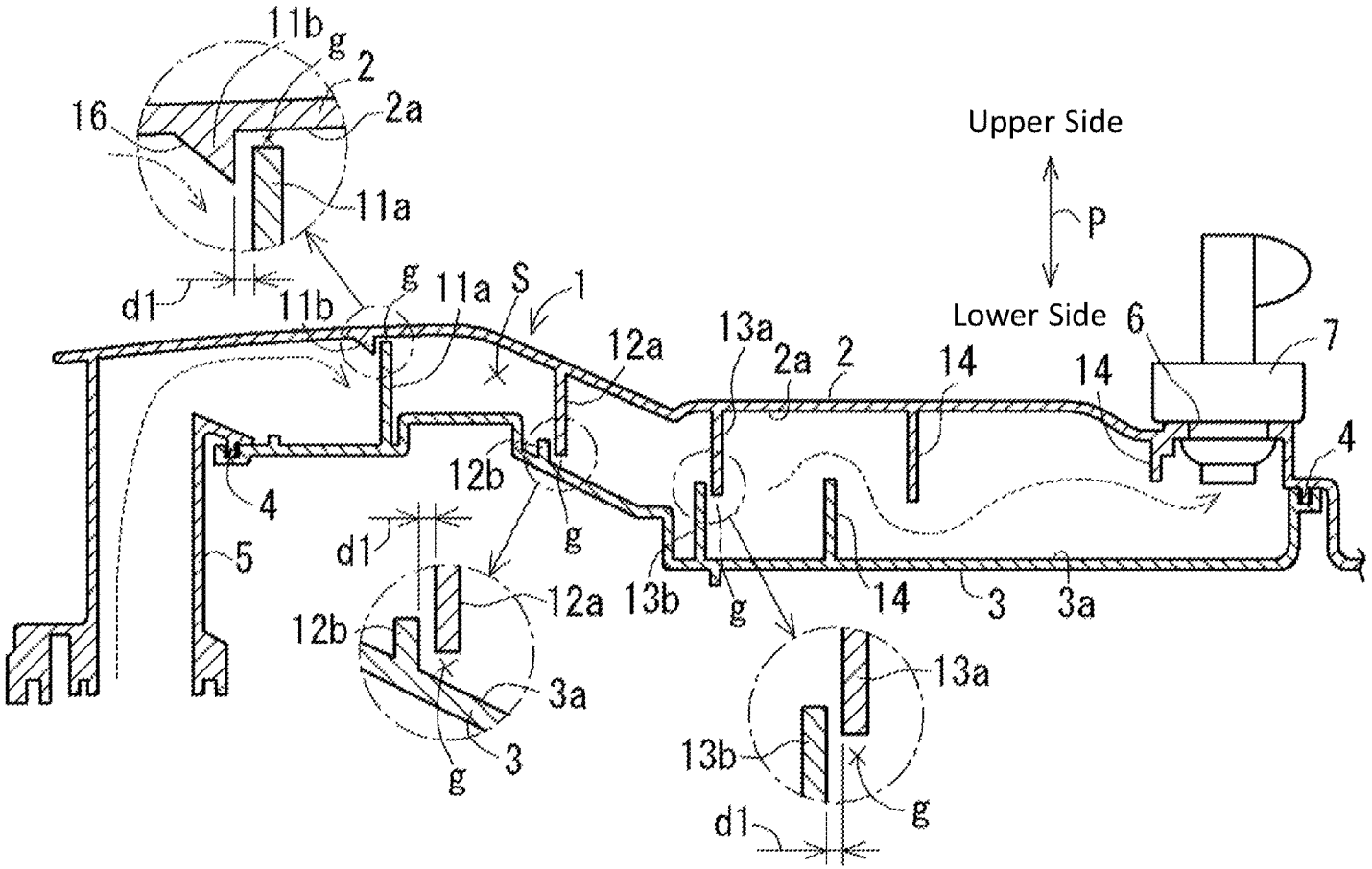
FIG. 2 is a cross-sectional view along line II-II of FIG. 1.

In the case with the embodiment described above, the first rib (11*a*) and the second rib (11*b*) for bending the gas path may be disposed opposite an inlet (5) for introducing the blow-by gas into the separator chamber (S) (see, for example, FIG. 2). In this case, for example, a pipe-like inlet (5) may be formed to the cylinder head cover (2) such as to open into the separator chamber (S) sideways at one end, while the first rib (11*a*) and the second rib (11*b*) for bending the gas path may be disposed opposite the opening at one end of the inlet.

The blow-by gas passage structure according to this embodiment may be formed to include, for example, a first rib (23*a*) and a second rib (23*b*) for blocking the flow of blow-by gas (see, for example, FIGS. 3 and 4) to block the flow of blow-by gas that travels from an oil drop hole (8) for discharging separated oil components from the separator chamber (S) toward an outlet (6) through which the blow-by gas is discharged from the separator chamber (S).

The blow-by gas passage structure according to this embodiment may be formed to include, for example, the second rib (11*b*) with an inclined surface (16) that separates from the gap in the up and down direction as it approaches the first rib (11*a*) (see, for example, FIG. 2).

The parenthesized reference numerals of various elements in the embodiments described above indicate the corresponding relationships with specific elements mentioned in embodiments to be described later.

EMBODIMENTS

Hereinafter, the present invention will be explained in specific terms through description of embodiments with reference to the drawings.

Embodiment 1

(1) Configuration of Blow-by Gas Passage Structure

The blow-by gas passage structure 1 according to this embodiment is provided inside a separator chamber S that is formed between a cylinder head cover 2 and a baffle plate 3, as shown in FIGS. 1 and 2. This blow-by gas passage structure 1 constitutes a passage for blow-by gas introduced into the separator chamber S.

The cylinder head cover 2 is made of a plastic material and formed in a box-like shape with its bottom side open. The baffle plate 3 is made of a plastic material and joined to the cylinder head cover 2 by vibration welding along a weld joint 4 such as to close the bottom side of the cylinder head cover. These cylinder head cover 2 and baffle plate 3 include respective opposite surfaces 2*a* and 3*a* facing each other in an up and down direction P of the cylinder head cover 2. A planar direction substantially orthogonal to the up and down direction P of the cylinder head cover 2 will be referred to as the planar direction of the cylinder head cover 2.

A substantially L-shaped pipe-like inlet 5 is provided to the cylinder head cover 2 for introducing the blow-by gas generated in the engine into the separator chamber S. Also, an outlet 6 for discharging the blow-by gas from the separator chamber S is provided to the cylinder head cover 2. A PCV (Positive Crankcase Ventilation) valve 7 is mounted to the outlet 6 for controlling the discharge amount of the blow-by gas. The baffle plate 3 is formed with an oil drop hole 8 for returning the oil caught and collected in the separator chamber S back to the engine.

The blow-by gas passage structure 1 includes the first ribs 11*a*, 12*a*, and 13*a*, and the second ribs 11*b*, 12*b*, and 13*b* for bending the gas path, and path-bending ribs 14. The first ribs 11*a*, 12*a*, and 13*a* and the second ribs 11*b*, 12*b*, and 13*b* for bending the gas path are ribs that cause the flow of blow-by gas inside the separator chamber S to bend (meander) along the planar direction of the cylinder head cover 2. The path-bending ribs 14 are ribs that cause the flow of blow-by gas inside the separator chamber S to bend (meander) in the up and down direction P of the cylinder head cover 2. As the flow of blow-by gas is bent by means of the ribs, the oil components (oil mist) in the blow-by gas are caught and collected through gravity sedimentation and collision against the ribs.

The first path-bending rib 11*a* stands on the opposite surface 3*a* (i.e., bottom surface 3*a*) of the baffle plate 3. This first rib 11*a* is formed in a planar shape with its distal end extending to near the opposite surface 2*a* (i.e., top surface 2*a*) of the cylinder head cover 2. A gap g of a predetermined height distance is formed between the distal end of the first rib 11*a* and the opposite surface 2*a* of the cylinder head cover 2.

The second path-bending rib 11*b* is provided on the opposite surface 2*a* of the cylinder head cover 2 at a position which is in the upstream of the first rib 11*a* in the flow of the blow-by gas and which is adjacent to the gap g. The distance d1 between the first rib 11*a* and the adjacent second rib 11*b* is about 3 mm. The second rib 11*b* is formed in the shape of a protrusion that covers the gap g. The second rib 11*b* has a height greater than that of the gap g. Namely, the second rib 11*b* faces the distal end of the first rib 11*a* in the planar direction of the cylinder head cover 2 such as to overlap it along the up and down direction P of the cylinder head cover 2. These first rib 11*a* and second rib 11*b* extend linearly so that they are substantially parallel to each other in the planar direction of the cylinder head cover 2.

The first rib 11*a* and second rib 11*b* for bending the gas path are disposed opposite one end of the inlet 5. The second rib 11*b* further includes an inclined surface 16 that separates from the gap g downward as it approaches the first rib 11*a*.

The first path-bending rib 12*a* stands on the opposite surface 2*a* of the cylinder head cover 2. This first rib 12*a* is formed in a planar shape with its distal end extending to near the opposite surface 3*a* of the baffle plate 3. A gap g of a predetermined height distance is formed between the distal end of the first rib 12*a* and the opposite surface 3*a* of the baffle plate 3.

The second path-bending rib 12*b* is provided on the opposite surface 3*a* of the baffle plate 3 at a position which is in the upstream of the first rib 12*a* in the flow of the blow-by gas and which is adjacent to the gap g. The distance d1 between the first rib 12*a* and the adjacent second rib 12*b* is about 3 mm. The second rib 12*b* is formed in the shape of a protrusion that covers the gap g. The second rib 12*b* has a height greater than that of the gap g. Namely, the second rib 12*b* faces the distal end of the first rib 12*a* in the planar direction of the cylinder head cover 2 such as to overlap it along the up and down direction P of the cylinder head cover 2. These first and second ribs 12*a* and 12*b* extend linearly so that they are substantially parallel to each other in the planar direction of the cylinder head cover 2.

The first path-bending rib 13*a* stands on the opposite surface 2*a* of the cylinder head cover 2. This first rib 13*a* is formed in a planar shape with its distal end extending to a midpoint of the distance between the opposing cylinder head cover 2 and the baffle plate 3. A gap g of a predetermined height distance is formed between the distal end of the first rib 13*a* and the opposite surface 3*a* of the baffle plate 3.

The second path-bending rib 13*b* stands on the opposite surface 3*a* of the baffle plate 3. This second rib 13*b* is provided at a position which is in the upstream of the first rib 13*a* in the flow of the blow-by gas and which is adjacent to the gap g. The distance d1 between the first rib 13*a* and the adjacent second rib 13*b* is about 3 mm. This second rib 13*b* is formed in a planar shape with its distal end extending to a midpoint of the distance between the opposing cylinder head cover 2 and the baffle plate 3. The second rib 13*b* has a height greater than that of the gap g. Namely, the distal ends of the first rib 13*a* and second rib 13*b* face each other in the planar direction of the cylinder head cover 2 such as to overlap each other along the up and down direction P of the cylinder head cover 2. These first rib 13*a* and second rib 13*b* extend linearly so that they are substantially parallel to each other in the planar direction of the cylinder head cover 2.

(2) Operation of the Blow-by Gas Passage Structure

Next, the operation of the blow-by gas passage structure 1 configured as described above will be explained. The blow-by gas introduced from the inlet 5 into the separator chamber S is bent along the planar direction of the cylinder head cover 2 by the first ribs 11*a*, 12*a*, and 13*a* and the second ribs 11*b*, 12*b*, and 13*b* for bending the gas path, and the oil components in the blow-by gas are caught through gravity sedimentation and collision. Next, as the flow of blow-by gas is bent by the path-bending ribs 14 in the up and down direction P of the cylinder head cover 2, the oil components in the blow-by gas are caught through gravity sedimentation and collision. After that, the blow-by gas, from which the oil components have been sufficiently separated, is discharged from the separator chamber S by the PCV valve 7 provided to the outlet 6, and transferred to the combustion chamber of the engine via an intake manifold. On the other hand, the oil caught and collected in the separator chamber S is returned to the engine via the oil drop hole 8.

(3) Effects of the Embodiments

In the blow-by gas passage structure 1 according to this embodiment, the cylinder head cover 2 and the baffle plate 3 include respective opposite surfaces 2*a* and 3*a* that face each other in an up and down direction P of the cylinder head cover 2. The opposite surface of one member of the cylinder head cover 2 and the baffle plate 3 is provided with the first ribs 11*a*, 12*a*, and 13*a*, while the opposite surface of the other member is provided with the second ribs 11*b*, 12*b*, and 13*b* at a position upstream of the first ribs 11*a*, 12*a*, and 13*a* in a flow of the blow-by gas and adjacent the gap g formed between the distal ends of the first ribs 11*a*, 12*a*, and 13*a* and the opposite surface of the other member. The second ribs 11*b*, 12*b*, and 13*b* have a height that is equal to or larger than the height of the gap g so as to prevent passing of the blow-by gas through the gap g. Thereby, passing of the blow-by gas through the gap g is prevented by the first ribs 11*a*, 12*a*, and 13*a* and the second ribs 11*b*, 12*b*, and 13*b*. As a result, the efficiency of separating oil components contained in the blow-by gas can be improved. Moreover, the first ribs 11*a*, 12*a*, and 13*a* and the second ribs 11*b*, 12*b*, and 13*b* enhance the surface rigidity of the cylinder head cover 2 and baffle plate 3, so that sound reduction and shock resistance are improved.

In this embodiment, the first ribs 11*a*, 12*a*, and 13*a* and second ribs 11*b*, 12*b*, and 13*b* are provided for bending the gas path. Accordingly, the flow of blow-by gas is bent in the planar direction of the cylinder head cover 2 inside the separator chamber S by the first path-bending ribs 11*a*, 12*a*, and 13*a* and the second path-bending ribs 11*b*, 12*b*, and 13*b*, so that the oil components in the blow-by gas are separated from the gas. Since passing of the blow-by gas through the gaps g is prevented by the first path-bending ribs 11*a*, 12*a*, and 13*a* and the second path-bending ribs 11*b*, 12*b*, and 13*b*, a flow path 20 of blow-by gas is formed as designed and intended, and the flow of blow-by gas can be bent sufficiently.

In this embodiment, the first path-bending rib 11*a* and the second path-bending rib 11*b* are disposed opposite the inlet 5. Accordingly, the oil components in the blow-by gas will be effectively separated, since the blow-by gas collides the first path-bending rib 11*a* and the second path-bending rib 11*b* with a high flow rate when it is introduced from the inlet 5 into the separator chamber S. Furthermore, passing of the blow-by gas with a high flow rate through the gaps g is prevented by the first path-bending rib 11*a* and the second path-bending rib 11*b*.

In this embodiment, the second rib 11*b* includes an inclined surface 16. Accordingly, the blow-by gas will be guided by the inclined surface 16 of the second rib 11*b* to move away from the gap g in the up and down direction. Therefore, passing of the blow-by gas through the gaps g can be prevented more reliably.

Embodiment 2

Next, a blow-by gas passage structure according to Embodiment 2 will be described. Constituent elements of the blow-by gas passage structure according to Embodiment 2 that are substantially the same as those of the blow-by gas passage structure 1 according to Embodiment 1 are given the same reference numerals and will not be described again in detail.

(1) Configuration of Blow-by Gas Passage Structure

Figure 3:
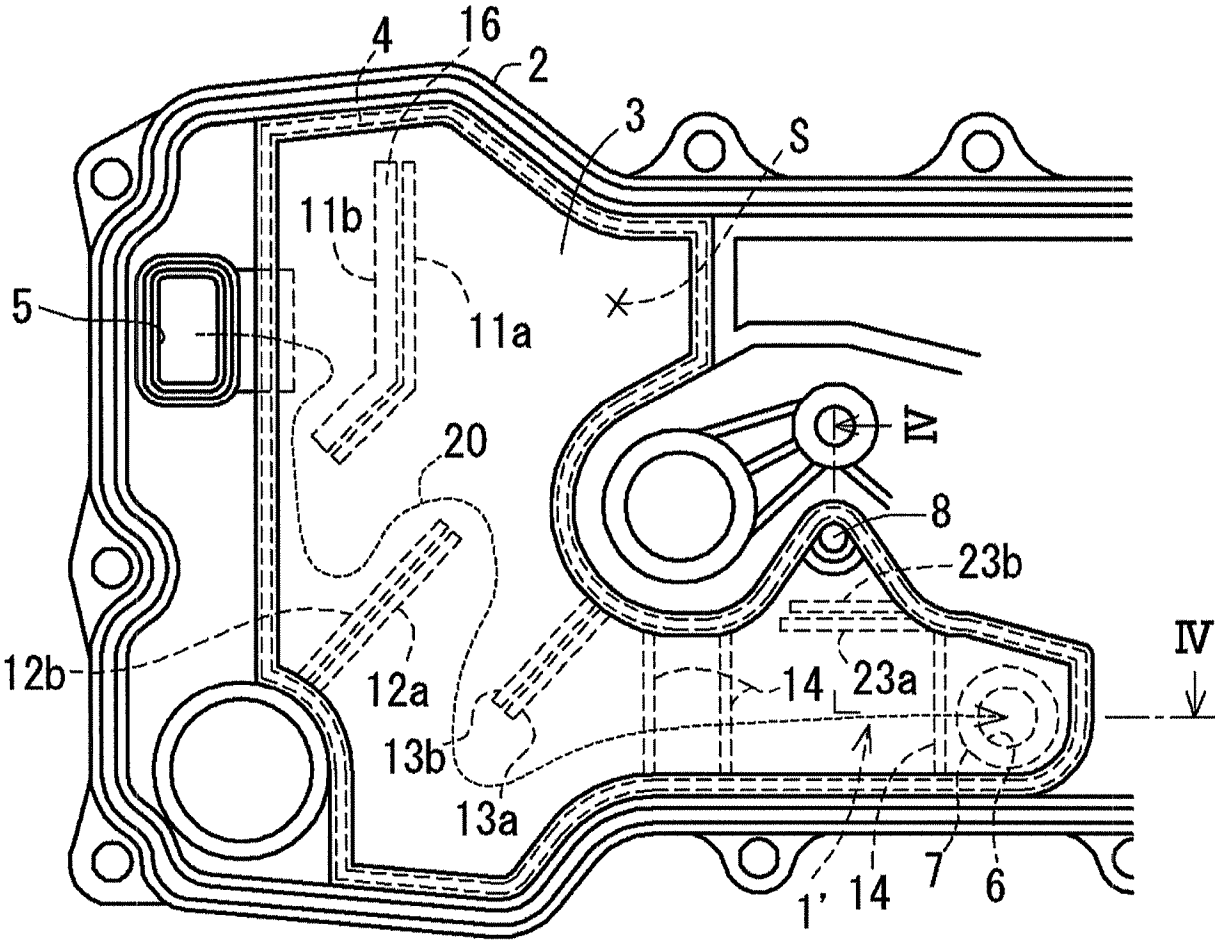
FIG. 3 is a backside view of essential parts of a cylinder head cover provided with a blow-by gas passage structure according to Embodiment 2.
Figure 4:
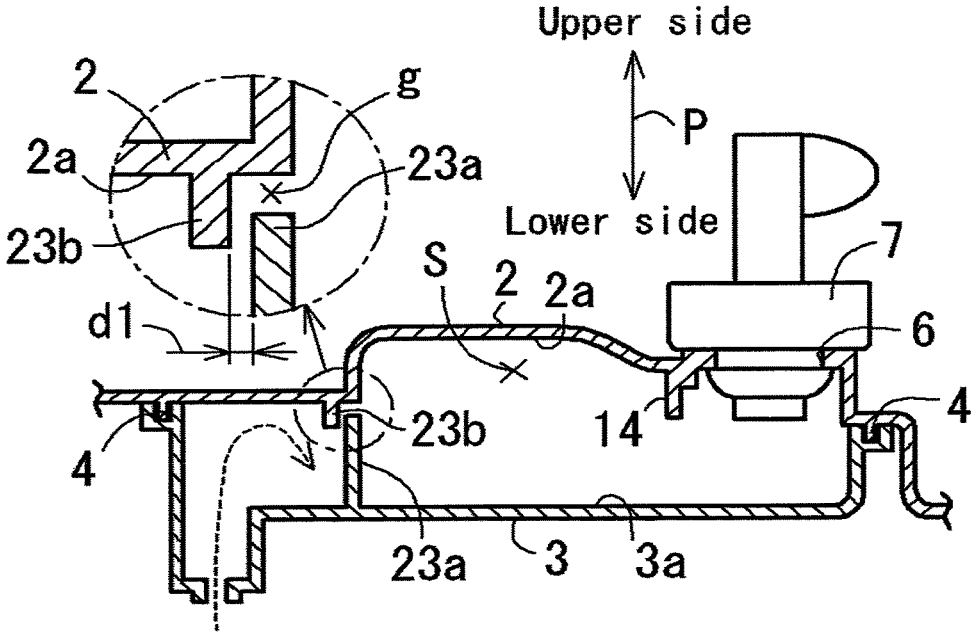
FIG. 4 is a cross-sectional view along line IV-IV of FIG. 3.

The blow-by gas passage structure 1' according to this embodiment is provided inside a separator chamber S that is formed between a cylinder head cover 2 and a baffle plate 3, as shown in FIGS. 3 and 4. An oil drop hole 8 is formed in this baffle plate 3 near the outlet 6 (i.e., near the PCV valve 7) of the cylinder head cover 2.

The blow-by gas passage structure 1' includes first ribs 11*a*, 12*a*, and 13*a*, and the second ribs 11*b*, 12*b*, and 13*b* for bending the gas path, path-bending ribs 14, and a first blocking rib 23*a* and a second blocking rib 23*b*. The first blocking rib 23*a* and the second blocking rib 23*b* are ribs provided for blocking the flow of blow-by gas that travels from the oil drop hole 8 toward the outlet 6 inside the separator chamber S.

The first path-bending rib 23*a* stands on the opposite surface 3*a* (i.e., bottom surface 3*a*) of the baffle plate 3. This first rib 23*a* is formed in a planar shape with its distal end extending to near the opposite surface 2*a* (i.e., top surface 2*a*) of the cylinder head cover 2. A gap g of a predetermined height distance is formed between the distal end of the first rib 23*a* and the opposite surface 2*a* of the cylinder head cover 2.

The second path-bending rib 23*b* is provided on the opposite surface 2*a* of the cylinder head cover 2 at a position which is in the upstream of the first rib 23*a* in the flow of the blow-by gas and which is adjacent to the gap g. The distance d1 between the first rib 23*a* and the adjacent second rib 23*b* is about 3 mm. The second rib 23*b* is formed in the shape of a protrusion that covers the gap g. The second rib 23*b* has a height greater than that of the gap g. Namely, the second rib 23*b* faces the distal end of the first rib 23*a* in the planar direction of the cylinder head cover 2 such as to overlap it along the up and down direction P of the cylinder head cover 2. The first rib 23*a* and the second rib 23*b* extend linearly so that they are substantially parallel to each other in the planar direction of the cylinder head cover 2.

(2) Operation and Effects of the Blow-by Gas Passage Structure

The blow-by gas passage structure 1' according to this embodiment operates substantially the same and provides substantially the same effects as the blow-by gas passage structure 1 of the previously described Embodiment 1. In addition, this embodiment includes the first blocking rib 23*a* and the second blocking rib 23*b*, so that the flow of blow-by gas traveling from the oil drop hole 8 toward the outlet 6 inside the separator chamber S is blocked by the first blocking rib 23*a* and the second blocking rib 23*b*. Also, since the first blocking rib 23*a* and the second blocking rib 23*b* prevent passing of the blow-by gas through the gap g, the effect of blocking the blow-by gas is enhanced.

The present invention is not limited to the embodiments described above and may be embodied with various changes made within the scope of the present invention in accordance with the purposes and applications. Namely, while the second ribs 11*b*, 12*b*, 13*b*, and 23*b* have a greater height than the height of the gap g in Embodiments 1 and 2 described above, the height is not limited to this. For example, the second ribs 11*b*, 12*b*, 13*b*, and 23*b* may have substantially the same height as that of the gap g.

While one form of the second rib 11*b* provided with an inclined surface 16 was shown in Embodiments 1 and 2 described above, the invention is not limited to this form. For example, the inclined surface 16 may be provided to other second ribs 12*b*, 13*b*, and 23*b*. Since the inlet 5 of the cylinder head cover 2 described above is formed by an undercut portion, the demolding direction is oblique, the inclined surface 16 of the second rib 11*b* can be formed easily. Furthermore, the second rib 11*b* may not be formed with the inclined surface 16, for example.

In Embodiments 1 and 2 described above, the second ribs 11*b* and 12*b* in the form of a protrusion are disposed upstream of the flow of the blow-by gas, while the first ribs 11*a* and 12*a* of a planar shape are disposed downstream. The invention is not limited to this form, and the second rib of a planar shape may be disposed upstream of the flow of blow-by gas while the first rib in the form of a protrusion may be disposed downstream, for example.

The shape, number, and arrangement of various ribs 11*a*, 11*b*, 12*a*, 12*b*, 13*a*, 13*b*, 23*a*, and 23*b* in Embodiments 1 and 2 described above may be selected as appropriate in accordance with the oil separation performance and the shape of the separator chamber S, and so on. While a labyrinth type oil separation structure was shown as an example in the embodiments, the invention is not limited to this. Instead of or in addition to the labyrinth type oil separation structure, for example, other oil separation structures that use a filter, centrifugal force, or gravity may be adopted.

The present invention is widely applied as a technique for forming a blow-by gas passage inside a separator chamber formed in a cylinder head cover of a vehicle such as a car, bus or truck.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

What is claimed is:

1. A blow-by gas passage structure provided inside a separator chamber that is formed between a cylinder head cover and a baffle plate joined to the cylinder head cover by vibration welding to form a passage for blow-by gas introduced into the separator chamber for separation of oil components, wherein the cylinder head cover and the baffle plate include respective opposite surfaces that face each other in an up and down direction of the cylinder head cover, the opposite surface of either one of the cylinder head cover and the baffle plate is provided with a first rib, and the opposite surface of the other member is provided with a second rib at a position which is in the upstream of the first rib in a flow of the blow-by gas and which is adjacent to a gap formed between a distal end of the first rib and the opposite surface of the other member, the second rib has a height that is equal to or greater than a height of the gap so as to prevent passing of the blow-by gas through the gap, and the first rib and the second rib are path-bending ribs adjacent to each other and distanced from each other by 1 to 10 mm so as to prevent passing of the blow-by gas through the gap and are structured and arranged to together divert the flow along an intended flow path to cause the flow of the blow-by gas to bend around both the first rib and the second rib along a planar direction of the cylinder head cover inside the separator chamber so as to flow along the intended flow path that does not pass through the gap.

2. The blow-by gas passage structure according to claim 1, wherein the first and second ribs are disposed opposite an inlet for introducing the blow-by gas into the separator chamber.

3. The blow-by gas passage structure according to claim 2, further comprising an additional first rib and second rib configured as blocking ribs provided for blocking a flow of blow-by gas traveling from an oil drop hole for discharging separated oil components from the separator chamber toward an outlet through which the blow-by gas is discharged from the separator chamber, and the blocking ribs adjacent to each other are distanced from each other by 1 to 10 mm so as to prevent passing of the blow-by gas through a second gap.

4. The blow-by gas passage structure according to claim 1, further comprising an additional first rib and second rib configured as blocking ribs provided for blocking a flow of blow-by gas traveling from an oil drop hole for discharging separated oil components from the separator chamber toward an outlet through which the blow-by gas is discharged from the separator chamber, and the blocking ribs adjacent to each other are distanced from each other by 1 to 10 mm so as to prevent passing of the blow-by gas through a second gap.

5. The blow-by gas passage structure according to claim 1, wherein the second rib includes an inclined surface that separates from the gap in the up and down direction as it approaches the first rib.

6. The blow-by gas passage structure according to claim 1, wherein the first and second ribs are disposed such as not to interfere with each other when the cylinder head cover and the baffle plate are joined together by vibration welding.

7. The blow-by gas passage structure according to claim 1, wherein facing surfaces of the first and second ribs are parallel to one another.

8. The blow-by gas passage structure according to claim 1, wherein the first rib is formed in a planar shape with its distal end extending to near the opposite surface of the other member.

9. The blow-by gas passage structure according to claim 1, wherein the inlet is formed in a L-shaped pipe structure operable to redirect a through flow and opening into the separator chamber at one end.

* * * * *